US007661939B2

(12) United States Patent
Su et al.

(10) Patent No.: US 7,661,939 B2
(45) Date of Patent: Feb. 16, 2010

(54) DRIVE SHAFT FOR A COMPRESSOR

(75) Inventors: Xiaogen Su, Suzhou (CN); Weihua Guo, Suzhou (CN); Yong Cao, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 305 days.

(21) Appl. No.: 11/728,596

(22) Filed: Mar. 26, 2007

(65) Prior Publication Data

US 2007/0231178 A1 Oct. 4, 2007

Related U.S. Application Data

(63) Continuation-in-part of application No. 11/390,964, filed on Mar. 28, 2006, now abandoned.

(51) Int. Cl.
*F01C 17/00* (2006.01)
*F03C 2/00* (2006.01)
*F04C 2/00* (2006.01)

(52) U.S. Cl. ..... 418/182; 418/55.5; 418/57; 384/447; 464/112; 464/132; 29/888.022; 29/428

(58) Field of Classification Search ..... 418/1, 418/55.1–55.6, 57, 102, 181, 182, 179; 74/570.1, 74/18.1, 18.2; 384/192, 447; 464/112, 132; 29/888.022, 428
See application file for complete search history.

(56) References Cited

U.S. PATENT DOCUMENTS 2,883,738 A * 4/1959 Morrow ..... 29/898.056
3,832,584 A 8/1974 DePaul
3,862,587 A 1/1975 Zajac et al.
3,869,877 A 3/1975 Brahler
4,222,617 A * 9/1980 Romberg ..... 384/192
4,730,998 A 3/1988 Kakuda et al.
4,775,351 A 10/1988 Provenzano, Jr.
4,836,758 A 6/1989 Elson et al.
4,877,382 A * 10/1989 Caillat et al. ..... 418/55.5
4,883,414 A 11/1989 Schabert
5,055,010 A * 10/1991 Logan ..... 418/55.6
5,230,616 A 7/1993 Serizawa
5,247,736 A * 9/1993 Fraser et al. ..... 418/55.1
5,403,171 A 4/1995 Sugita et al.

(Continued)

FOREIGN PATENT DOCUMENTS

JP 62-13789 1/1987

(Continued)

OTHER PUBLICATIONS

International Preliminary Report on Patentability regarding International Application No. PCT/US2007/007625 dated Sep. 30, 2008.

(Continued)

*Primary Examiner*—Theresa Trieu
(74) *Attorney, Agent, or Firm*—Harness, Dickey & Pierce, P.L.C.

(57) ABSTRACT

A compressor drive shaft may include a first bearing portion, a second bearing portion, and an intermediate portion disposed therebetween. The intermediate portion may include a continuous, nonlinear, central axis in an unloaded state.

39 Claims, 6 Drawing Sheets

U.S. PATENT DOCUMENTS

| | | | | |
|---|---|---|---|---|
| 5,528,976 | A | 6/1996 | Ikeda | |
| 5,983,738 | A | 11/1999 | Delaisse | |
| 6,109,899 | A | 8/2000 | Barito et al. | |
| 6,264,448 | B1 * | 7/2001 | Itoh et al. | 418/55.4 |
| 6,821,092 | B1 * | 11/2004 | Gehret et al. | 417/213 |

FOREIGN PATENT DOCUMENTS

| | | |
|---|---|---|
| JP | 02-153289 | 6/1990 |
| JP | 7-253085 | 10/1995 |
| JP | 07-301177 | 11/1995 |

OTHER PUBLICATIONS

Written Opinion of the International Searching Authority dated Aug. 27, 2007.
PCT International Search Report dated Aug. 27, 2007.
Non-Final Office Action issued by U.S. Patent and Trademark Office dated Nov. 26, 2007 from related U.S. Appl. No. 11/390,964, filed Mar. 28, 2006, entitled "Drive Shaft for a Compressor" (8 pages).

* cited by examiner

DRIVE SHAFT FOR A COMPRESSOR

CROSS-REFERENCE TO RELATED APPLICATIONS

This application is a continuation-in-part of U.S. patent application Ser. No. 11/390,964 filed on Mar. 28, 2006. The disclosure of the above application is incorporated herein by reference.

FIELD

The present disclosure relates to compressors, and more specifically to a drive shaft for a compressor.

BACKGROUND

The statements in this section merely provide background information related to the present disclosure and may not constitute prior art.

During scroll compressor operation, a drive shaft experiences loads from a variety of sources including a compression mechanism being driven, counterweights, and rotor torque, as well as reaction loads from bearings. These loads cause bending of the drive shaft during operation of the compressor. Operating loads in scroll compressors rotate with the drive shaft. As such, the drive shaft typically has a first portion in tension and a second portion in compression during each revolution of the drive shaft. The stress at a specific location may vary, but there is not a reversal of tension and compression. The bending of the drive shaft under load causes shaft ends housed in bearings to cause bearing wear due to an angular orientation within the bearing, which may result in compressor failure. In order to protect against this bending, drive shafts are often constructed with increased diameters to account for high load conditions.

SUMMARY

Accordingly, a compressor drive shaft may include a first bearing portion, a second bearing portion, and an intermediate portion disposed therebetween. The intermediate portion may include a continuous, nonlinear, central axis in an unloaded state.

A compressor may include a shell, first and second bearing housings, a drive shaft, a motor, and a compression mechanism. The first bearing housing may be contained within the shell and may have a first bearing contained therein. The second bearing housing may be contained within the shell and may have a second bearing contained therein. The drive shaft may have a first bearing portion, a second bearing portion, and an intermediate portion disposed therebetween. The first bearing portion may be located within the first bearing and the second bearing portion may be located within the second bearing, the drive shaft may have a rotational axis generally parallel to bearing surfaces of the first and second bearings. The intermediate portion may include a continuous, nonlinear, central axis in an unloaded state. The motor may be contained within the shell and may be drivingly coupled to the drive shaft. The compression mechanism may be in a driven engagement with the drive shaft.

A method of forming a compressor drive shaft may include supporting the drive shaft at a first location along a length thereof and applying a load that exceeds a yield point of the drive shaft to a second location along a length thereof to permanently deform the drive shaft a predetermined amount to a nonlinear form.

Further areas of applicability will become apparent from the description provided herein. It should be understood that the description and specific examples are intended for purposes of illustration only and are not intended to limit the scope of the present claims.

DRAWINGS

The drawings described herein are for illustration purposes only and are not intended to limit the scope of the present teachings in any way.

DETAILED DESCRIPTION

Figure 1:
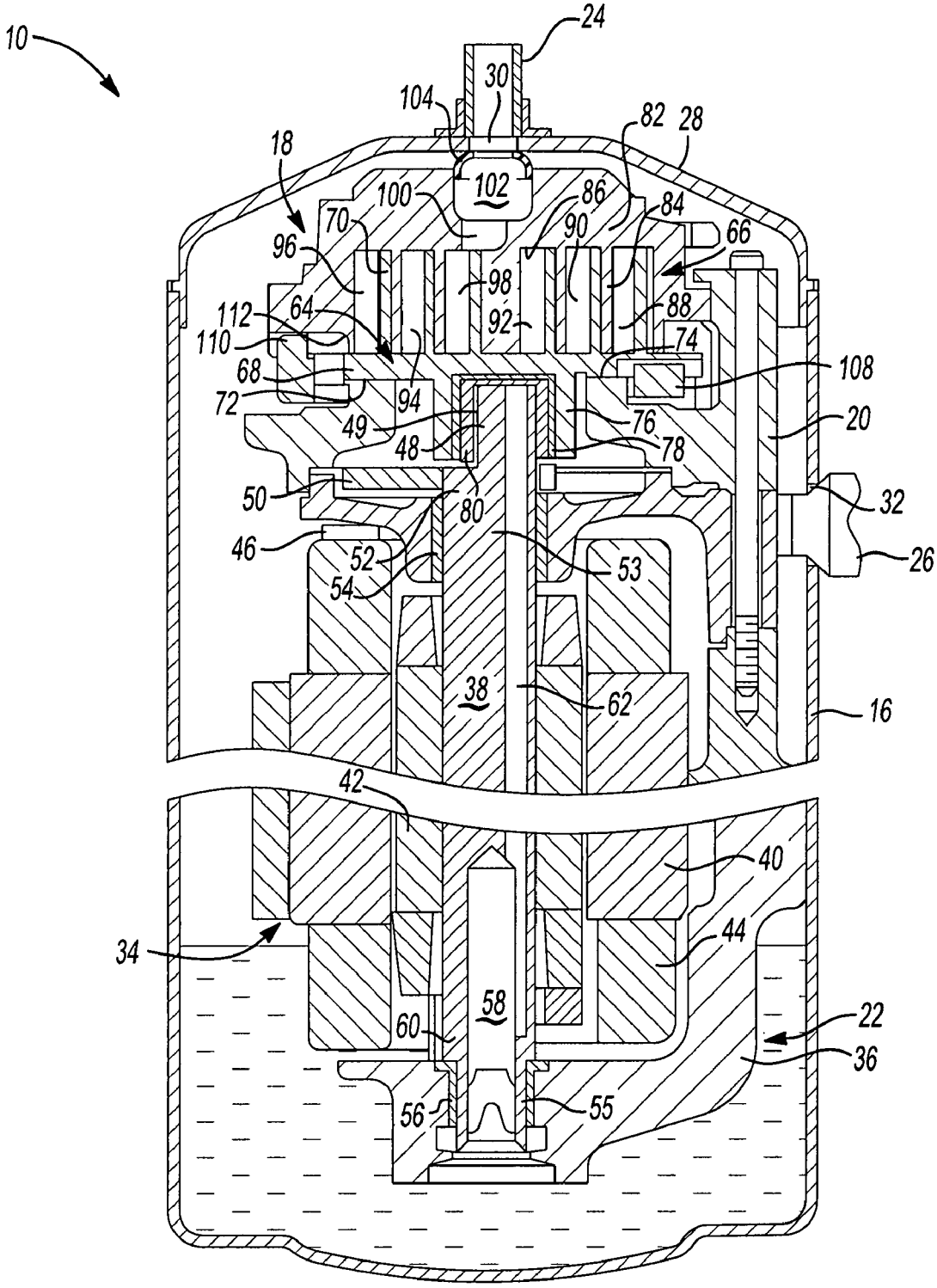
FIG. 1 is a section view of a compressor.

The following description is merely exemplary in nature and is not intended to limit the present teachings, application, or uses.

The present teachings are suitable for incorporation in many different types of scroll compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

Compressor 10 may include a cylindrical hermetic shell 16, a compression mechanism 18, a main bearing housing 20, a motor assembly 22, a refrigerant discharge fitting 24, and a suction gas inlet fitting 26. The hermetic shell 16 may house the compression mechanism 18, main bearing housing 20, and motor assembly 22. Shell 16 may include an end cap 28 at the upper end thereof. The refrigerant discharge fitting 24 may be attached to shell 16 at opening 30 in end cap 28. The suction gas inlet fitting 26 may be attached to shell 16 at opening 32. The compression mechanism 18 may be driven by motor assembly 22 and supported by main bearing housing 20. The main bearing housing 20 may be affixed to shell 16 at a plurality of points in any desirable manner.

The motor assembly 22 may generally include a motor 34, a frame 36 and a drive shaft 38. The motor 34 may include a motor stator 40 and a rotor 42. The motor stator 40 may be press fit into frame 36, which may in turn be press fit into shell 16. Drive shaft 38 may be rotatably driven by rotor 42. Windings 44 may pass through stator 40. Rotor 42 may be press fit on drive shaft 38. A motor protector 46 may be provided in close proximity to windings 44 so that motor protector 46 will de-energize motor 34 if windings 44 exceed their normal temperature range.

Drive shaft 38 may include an eccentric crank pin 48 having a flat 49 thereon and one or more counter-weights 50 at an upper end 52. Drive shaft 38 may include a first bearing portion 53 rotatably journaled in a first bearing 54 in main bearing housing 20 and a second bearing portion 55 rotatably journaled in a second bearing 56 in frame 36. Drive shaft 38 may include an oil-pumping concentric bore 58 at a lower end 60. Concentric bore 58 may communicate with a radially outwardly inclined and relatively smaller diameter bore 62 extending to the upper end 52 of drive shaft 38. The lower interior portion of shell 16 may be filled with lubricating oil. Concentric bore 58 may provide pump action in conjunction with bore 62 to distribute lubricating fluid to various portions of compressor 10. Drive shaft 38 may have a pre-bent configuration, as discussed below.

Compression mechanism 18 may generally include an orbiting scroll 64 and a non-orbiting scroll 66. Orbiting scroll 64 may include an end plate 68 having a spiral vane or wrap 70 on the upper surface thereof and an annular flat thrust surface 72 on the lower surface. Thrust surface 72 may interface with an annular flat thrust bearing surface 74 on an upper surface of main bearing housing 20. A cylindrical hub 76 may project downwardly from thrust surface 72 and may include a journal bearing 78 having a drive bushing 80 rotatively disposed therein. Drive bushing 80 may include an inner bore in which crank pin 48 is drivingly disposed. Crank pin flat 49 may drivingly engage a flat surface in a portion of the inner bore of drive bushing 80 to provide a radially compliant driving arrangement, such as shown in assignee's U.S. Pat. No. 4,877,382, the disclosure of which is herein incorporated by reference.

Non-orbiting scroll 66 may include an end plate 82 having a non-orbiting spiral wrap 84 on lower surface 86 thereof. Non-orbiting spiral wrap 84 may form a meshing engagement with wrap 70 of orbiting scroll 64, thereby creating an inlet pocket 88, intermediate pockets 90, 92, 94, 96, and outlet pocket 98. Non-orbiting scroll 66 may have a centrally disposed discharge passageway 100 in communication with outlet pocket 98 and upwardly open recess 102 which may be in fluid communication with discharge fitting 24. A flip seal 104 may be located around recess 102 and abut shell 16, thereby providing sealed communication between discharge passageway 100 and discharge fitting 24, while allowing axial displacement of non-orbiting scroll 66 relative to shell 16.

Non-orbiting scroll 66 may be mounted to main bearing housing 20 in any manner that will provide limited axial movement of non-orbiting scroll 66. For a more detailed description of the non-orbiting scroll suspension system, see assignee's U.S. Pat. No. 5,055,010, the disclosure of which is hereby incorporated herein by reference. A variety of seals may also be included for sealing between the end cap 28 and non-orbiting scroll 66. FIG. 1 shows a first exemplary sealing member being a flip seal 104, as described in Assignee's U.S. Pat. No. 6,821,092, the disclosure of which is herein incorporated by reference. Other seals, such as floating seals, may be used as well.

Axial pressure biasing may be included in compressor 10, as disclosed in Assignee's aforesaid U.S. Pat. No. 4,877,382. A capacity modulation system may also be included in the system, as described in Assignee's aforesaid U.S. Pat. No. 6,821,092.

Relative rotation of the scrolls 64, 66 may be prevented by an Oldham coupling, which may generally include a ring 108 having a first pair of keys 110 (one of which is shown) slidably disposed in diametrically opposed slots 112 (one of which is shown) in non-orbiting scroll 66 and a second pair of keys (not shown) slidably disposed in diametrically opposed slots in orbiting scroll 64.

Figure 2:
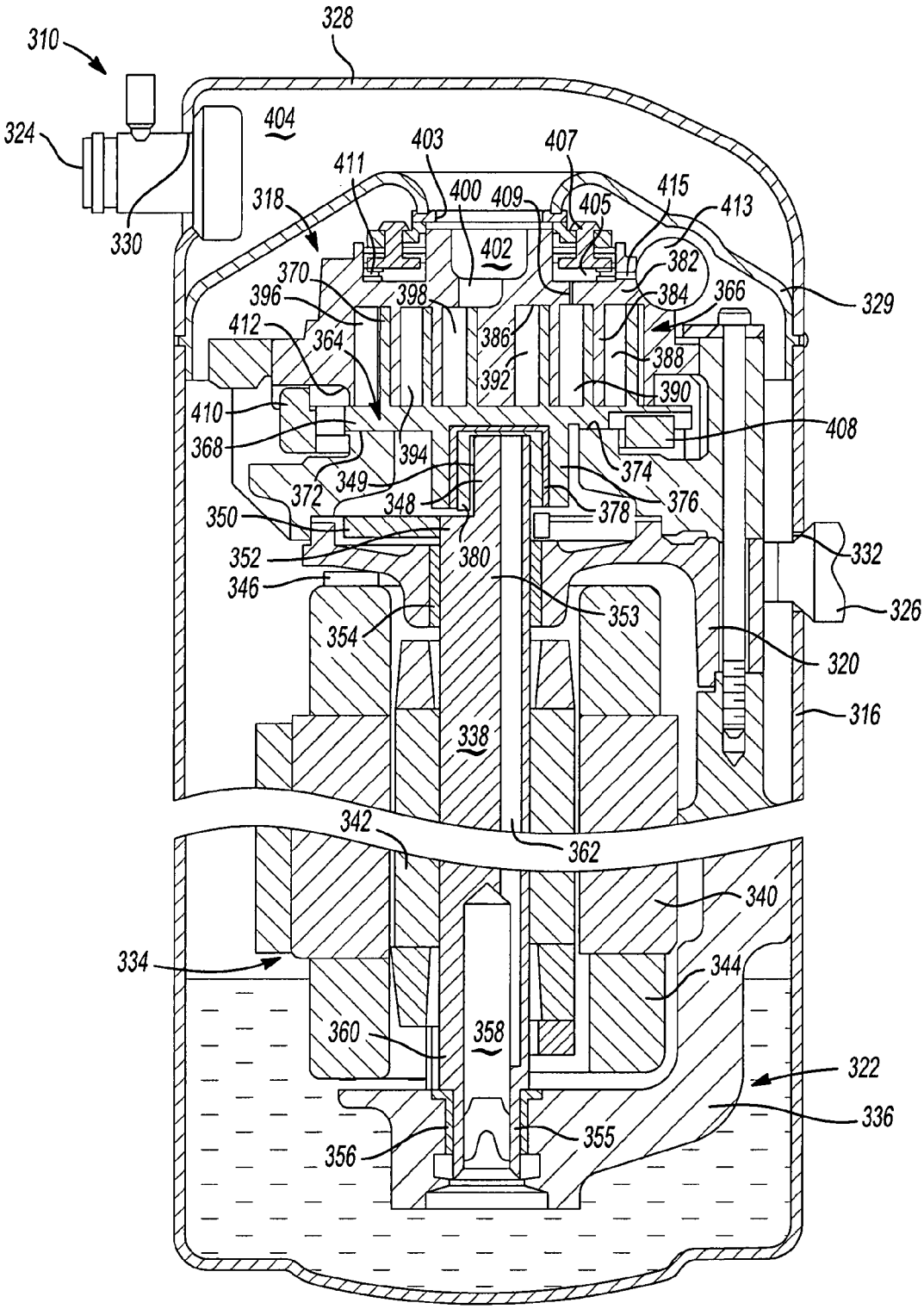
FIG. 2 is a section view of an alternate compressor.

Alternately, the present teachings may be incorporated into an alternate compressor 310, seen in FIG. 2. Compressor 310 may include a cylindrical hermetic shell 316, a compression mechanism 318, a main bearing housing 320, a motor assembly 322, a refrigerant discharge fitting 324, and a suction gas inlet fitting 326. The hermetic shell 316 may house the compression mechanism 318, main bearing housing 320, and motor assembly 322. Shell 316 may include an end cap 328 at the upper end thereof and a transversely extending portion 329. The refrigerant discharge fitting 324 may be attached to shell 316 at opening 330 in end cap 328. The suction gas inlet fitting 326 may be attached to shell 316 at opening 332. The compression mechanism 318 may be driven by motor assembly 322 and supported by main bearing housing 320. The main bearing housing 320 may be affixed to shell 16 at a plurality of points in any desirable manner.

The motor assembly 322 may generally include a motor 334, a frame 336 and a drive shaft 338. The motor 334 may include a motor stator 340 and a rotor 342. The motor stator 340 may be press fit into frame 336, which may in turn be press fit into shell 316. Drive shaft 338 may be rotatably driven by stator 340. Windings 344 may pass through stator 340. Rotor 342 may be press fit on drive shaft 338. A motor protector 346 may be provided in close proximity to windings 344 so that motor protector 346 will de-energize motor 334 if windings 344 exceed their normal temperature range.

Drive shaft 338 may include an eccentric crank pin 348 having a flat 349 thereon and one or more counter-weights 350 at an upper end 352. Drive shaft 338 may include a first bearing portion 353 rotatably journaled in a first bearing 354 in main bearing housing 320 and a second bearing portion 355 rotatably journaled in a second bearing 356 in frame 336. Drive shaft 338 may include an oil-pumping concentric bore 358 at a lower end 360. Concentric bore 358 may communicate with a radially outwardly inclined and relatively smaller diameter bore 362 extending to the upper end 352 of drive shaft 338. The lower interior portion of shell 316 may be filled with lubricating oil. Concentric bore 358 may provide pump action in conjunction with bore 362 to distribute lubricating fluid to various portions of compressor 310. Drive shaft 338 may have a pre-bent configuration, as discussed below.

Compression mechanism 318 may generally include an orbiting scroll 364 and a non-orbiting scroll 366. Orbiting scroll 364 may include an end plate 368 having a spiral vane or wrap 370 on the upper surface thereof and an annular flat thrust surface 372 on the lower surface. Thrust surface 372 may interface with an annular flat thrust bearing surface 374 on an upper surface of main bearing housing 320. A cylindrical hub 376 may project downwardly from thrust surface 372 and may include a journal bearing 378 having a drive bushing 380 rotatively disposed therein. Drive bushing 380 may include an inner bore in which crank pin 348 is drivingly disposed. Crank pin flat 349 may drivingly engage a flat surface in a portion of the inner bore of drive bushing 380 to provide a radially compliant driving arrangement, such as shown in Assignee's aforesaid U.S. Pat. No. 4,877,382.

Non-orbiting scroll 366 may include an end plate 382 having a non-orbiting spiral wrap 384 on lower surface 386 thereof. Non-orbiting spiral wrap 384 may form a meshing engagement with wrap 370 of orbiting scroll 364, thereby creating an inlet pocket 388, intermediate pockets 390, 392, 394, 396, and outlet pocket 398. Non-orbiting scroll 366 may have a centrally disposed discharge passageway 400 in communication with outlet pocket 398 and upwardly open recess 402 which may be in fluid communication via an opening 403 in partition 329 with a discharge muffler chamber 404 defined by end cap 328 and partition 329.

Non-orbiting scroll 366 has in the upper surface thereof an annular recess 405 having parallel coaxial side walls in which is sealingly disposed for relative axial movement an annular floating seal 407 which serves to isolate the bottom of recess 405 from the presence of gas under suction and discharge pressure so that it can be placed in fluid communication with a source of intermediate fluid pressure by means of a passageway 409. A spring 411 may urge floating seal 407 upward to maintain a sealing engagement. Non-orbiting scroll 366 is thus axially biased against orbiting scroll member 350 by the forces created by discharge pressure acting on the central portion of non-orbiting scroll 366 and those created by intermediate fluid pressure acting on the bottom of recess 405. This axial pressure biasing, as well as various techniques for supporting non-orbiting scroll 366 for limited axial movement, are disclosed in much greater detail in Assignee's aforesaid U.S. Pat. No. 4,877,382.

Compressor 310 may use a dual pressure balancing scheme to axially balance non-orbiting scroll 366 with floating seal 407 being used to separate the discharge gas pressure from the suction gas pressure.

A solenoid valve 413 may be used to open and close a passageway 415 located within non-orbiting scroll 366. Passageway 415 extends from the bottom of recess 405 which is at intermediate pressure during operation of compressor 310 to the area of compressor 310 which contains suction gas at suction gas pressure.

Relative rotation of the scrolls 364, 366 may be prevented by an Oldham coupling, which may generally include a ring 408 having a first pair of keys 410 (one of which is shown) slidably disposed in diametrically opposed slots 412 (one of which is shown) in non-orbiting scroll 366 and a second pair of keys (not shown) slidably disposed in diametrically opposed slots in orbiting scroll 364.

Figure 3:
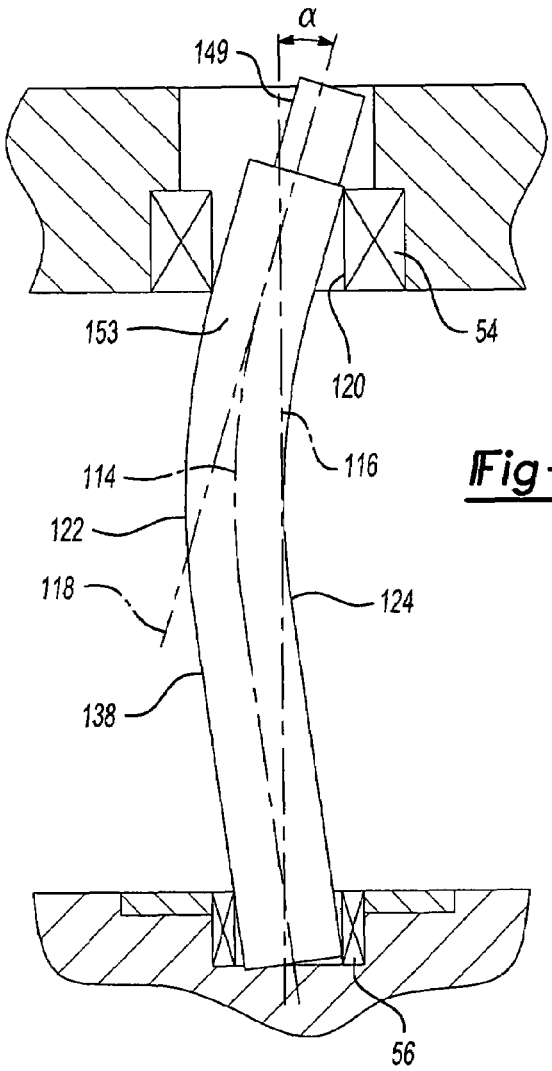
FIG. 3 is an exaggerated view of a compressor drive shaft under an operating load.

With additional reference to FIG. 3, a typical generally linear drive shaft 138 is shown housed in first and second bearings 54, 56. For illustrative purposes, the curvature of drive shaft 138 is exaggerated in FIG. 3 to depict the deflection of drive shaft 138 during compressor operation. Specifically, FIG. 3 depicts deflection of drive shaft 138 under a maximum load and illustrates a maximum tilt angle α, which is defined as the angle between a tangent line 118 and a rotational axis 116. Drive shaft 138 may include a centerline 114 which may intersect rotational axis 116 at both the first and second bearings 54, 56. Tangent line 118 is defined relative to centerline 114, and may be formed at the intersection between centerline 114 and rotational axis 116 in first bearing 54. First bearing portion 153 may be generally disposed within first bearing 54 at an angle that generally approximates maximum tilt angle α relative to first bearing wall 120.

During operation, deflection of drive shaft 138 may occur at a similar location throughout a complete rotation. This deflection is due to the applied loads acting on drive shaft 138, and therefore bearing reaction loads, rotating with drive shaft 138. These loads may include loads from a compression mechanism, counterweights, and rotor torque, as well as reaction loads from bearings. As such, a first radial side 122 of drive shaft 138 may always be under tension and a second radial side 124 of drive shaft 138 may always be under compression during operation of compressor 10. First radial side 122 may be generally opposite second radial side 124. More specifically, when drive shaft 138 is used in a scroll compressor similar to that in FIGS. 1 and 2, first radial side 122 may be the side that crank pin flat 149 is disposed on.

Figure 4:
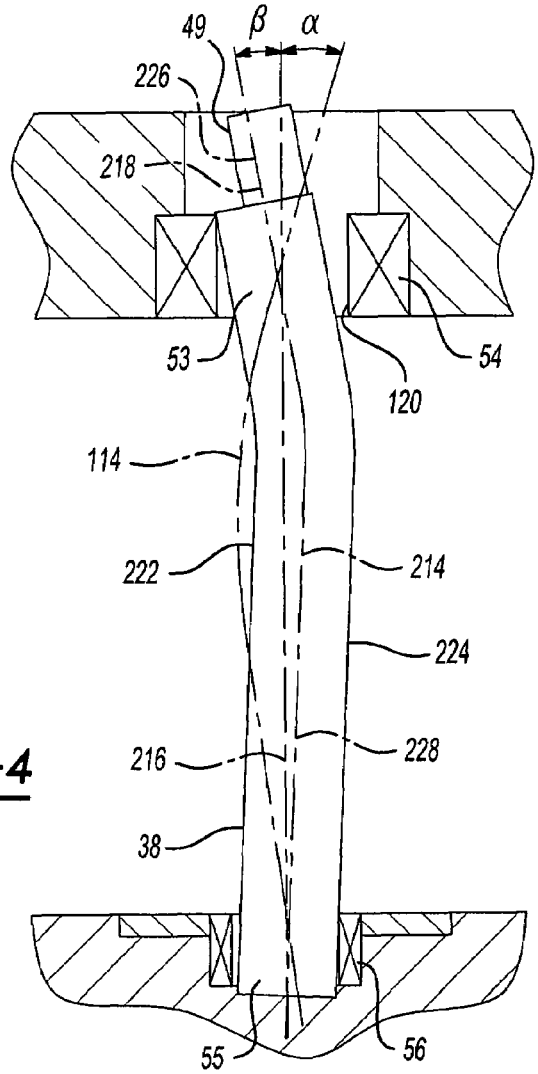
FIG. 4 is an exaggerated view of a pre-bent compressor drive shaft under no load.

While the following description relates to drive shaft 38 and compressor 10, it is understood that the description applies equally to drive shaft 338 and compressor 310 shown in FIG. 2. As noted above, and shown in FIG. 4, drive shaft 38 may have a pre-bent configuration to compensate for the deflection occurring during compressor operation. FIG. 4 shows drive shaft 38 in an exaggerated form for illustrative purposes. Drive shaft 38 may have a pre-bent nonlinear structure to account for some of the deflection that may occur mentioned above and shown in FIG. 3. Drive shaft 38 may have a continuous curvature along its entire length or merely a portion thereof. Additionally, a portion of drive shaft 38 may be linear, such as first bearing portion 53, and another portion may be nonlinear (or curved). The nonlinear portion may be centrally disposed along the length of drive shaft 38 (creating a central locus of curvature) or may be biased toward an end thereof (creating a non-central locus of curvature).

As described above regarding drive shaft 138 in FIG. 3, drive shaft 38 may include a centerline 214 and a rotational axis 216. Rotational axis 216 may be generally similar to rotational axis 116 in drive shaft 138. Centerline 214 and rotational axis 216 may intersect at both the first and second bearings 54, 56. A tangent line 218 to centerline 214 may be formed at the intersection between centerline 214 and rotational axis 216 in first bearing 54. Angle β may be defined as the angle between tangent line 218 and rotational axis 216. Drive shaft 38 may include a generally continuous curved body. More specifically, centerline 214 may form a generally continuous curve having first and second linear portions 226, 228 extending through first and second bearing portions 53, 55 and connected to one another by a generally smooth curved portion extending therebetween. Second linear portion 228 may extend along a portion of drive shaft 38 that rotor 42 is in a press fit engagement with. As such, the generally smooth curved portion may be located between rotor 42 and first bearing 54 when drive shaft 38 is assembled in compressor 10. Centerline 214 may form a first central axis, first linear portion 226 may extend along tangent line 218 and may form a second central axis, and rotational axis 216 may form a third central axis. As indicated above, rotational axis 216 may be generally similar to rotational axis 116 in drive shaft 138 and may therefore generally correspond to a central axis of first bearing portion 153 of linear drive draft 138 during an unloaded state of linear drive shaft 138.

In order to compensate for the deflection described above, drive shaft 38 may be bent in a direction generally opposite the direction of deflection during operation. Specifically, drive shaft 38 may be bent in such a manner that first bearing portion 53 may be disposed at an angle that generally approximates angle β relative to first bearing wall 120 when compressor 10 is in a non-operating state. Angle β may generally be between $-\alpha/4$ and $-\alpha$ degrees. More specifically, angle β may generally be equal to approximately $-\alpha/2$ degrees. While described in terms of $-\alpha$, angle β may also be described in terms of $+\alpha$, with the understanding that angle β may extend generally opposite angle α.

The angle α, and therefore the angle β, may be defined in terms of first bearing 54 housing drive shaft 38 therein. More specifically, α may be defined by:

$$\alpha=\arctan(c/H)$$

where c is the diametrical clearance between drive shaft 38 and first bearing 54 and H is the height, or axial extent, of first bearing 54. Since angle β is a function of angle α, as discussed above, angle β may be defined in terms of diametrical clearance (c) and height (H) based on the relationship between angle α and angle β discussed above.

The pre-bent structure of drive shaft 38 may provide for a reduced diameter of drive shaft 38 relative to a typical linear drive shaft. This reduced diameter may result in a reduced compressor bearing diameter, such as the diameter of first bearing 54. This bearing diameter reduction may be characterized by an increase in the ratio of the distance between bearings (L) and bearing inner diameter (d). More specifically, the ratio (L/d) may generally be greater than or equal to 10. An increased L/d ratio may provide for the use of additional lamination material for a given motor diameter, resulting in a more efficient motor.

In the example of scroll compressor 10, shown in FIG. 1, first radial side 222 may be the side that crank pin flat 49 is disposed on. Additionally, first radial side 222 on drive shaft 38 may generally correspond to first radial side 122 on drive shaft 138 and second radial side 224 on drive shaft 38 may generally correspond to second radial side 124 on drive shaft 138. As a result, the net bending of drive shaft 38 under loading during operation may be reduced. For example, if drive shaft 38 has a pre-bend of $-\alpha/2$, the maximum tilt angle under load may be reduced from $\alpha$ to $\alpha/2$, a fifty percent improvement.

Maximum tilt angle $\alpha$ may be determined in a number of ways including advanced methods such as Finite Element Analysis (FEA). Once maximum tilt angle $\alpha$ has been determined, or at least approximated, angle $\beta$ may be determined. Angle $\alpha$ may generally be between 0.06 and 0.28 degrees, depending on compressor operation. As such, angle $\beta$ may generally be between −0.03 and −0.14 degrees when $\beta$ is approximately equal to $-\alpha/2$. Angle $\beta$ may be more or less depending on the application, as loads may vary depending on the compressor application. For example, angle $\beta$ may generally be less than or equal to −0.05 degrees (or greater than or equal to 0.05 degrees if expressed as a positive angle, as discussed above), or more specifically, less than or equal to −0.10 degrees (or greater than or equal to 0.10 degrees if expressed as a positive angle, as discussed above).

While drive shaft 38 has been described in a scroll compressor environment, the application of a pre-bent drive shaft extends to other areas as well. For example, a pre-bent drive shaft may be beneficial for use in a vane-type compressor, various turbine machines, or any other apparatus having loads rotating together with a drive shaft.

Pre-bent drive shaft 38 may be formed from a variety of materials including carbon steel (including low carbon steel and case hardened steel), as well as ductile iron. The pre-bent structure of drive shaft 38 may provide for use of materials with a lower modulus of elasticity than carbon steel, such as ductile iron.

Figure 5:
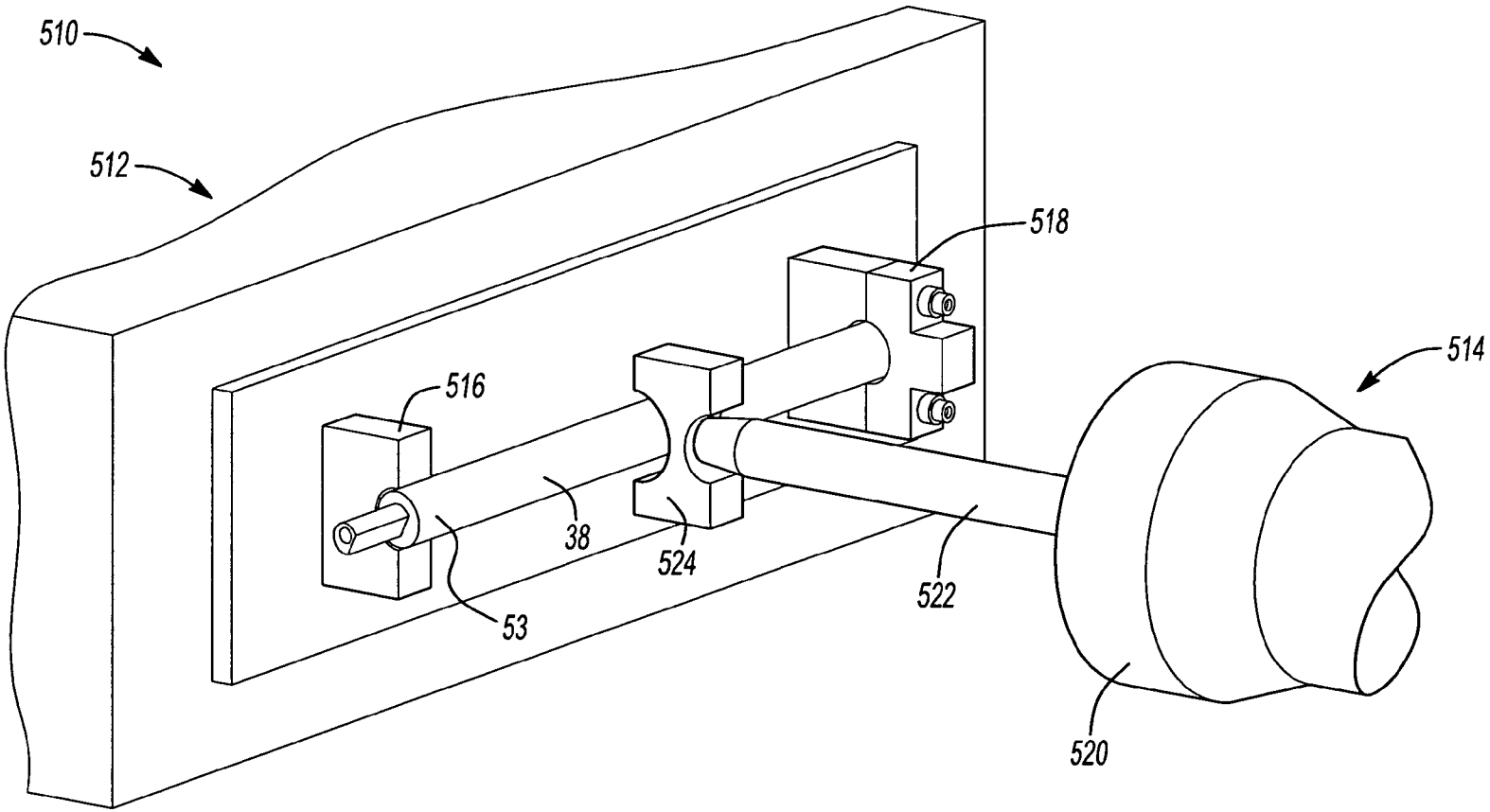
FIG. 5 is a perspective view of a drive shaft bending apparatus.
Figure 6:
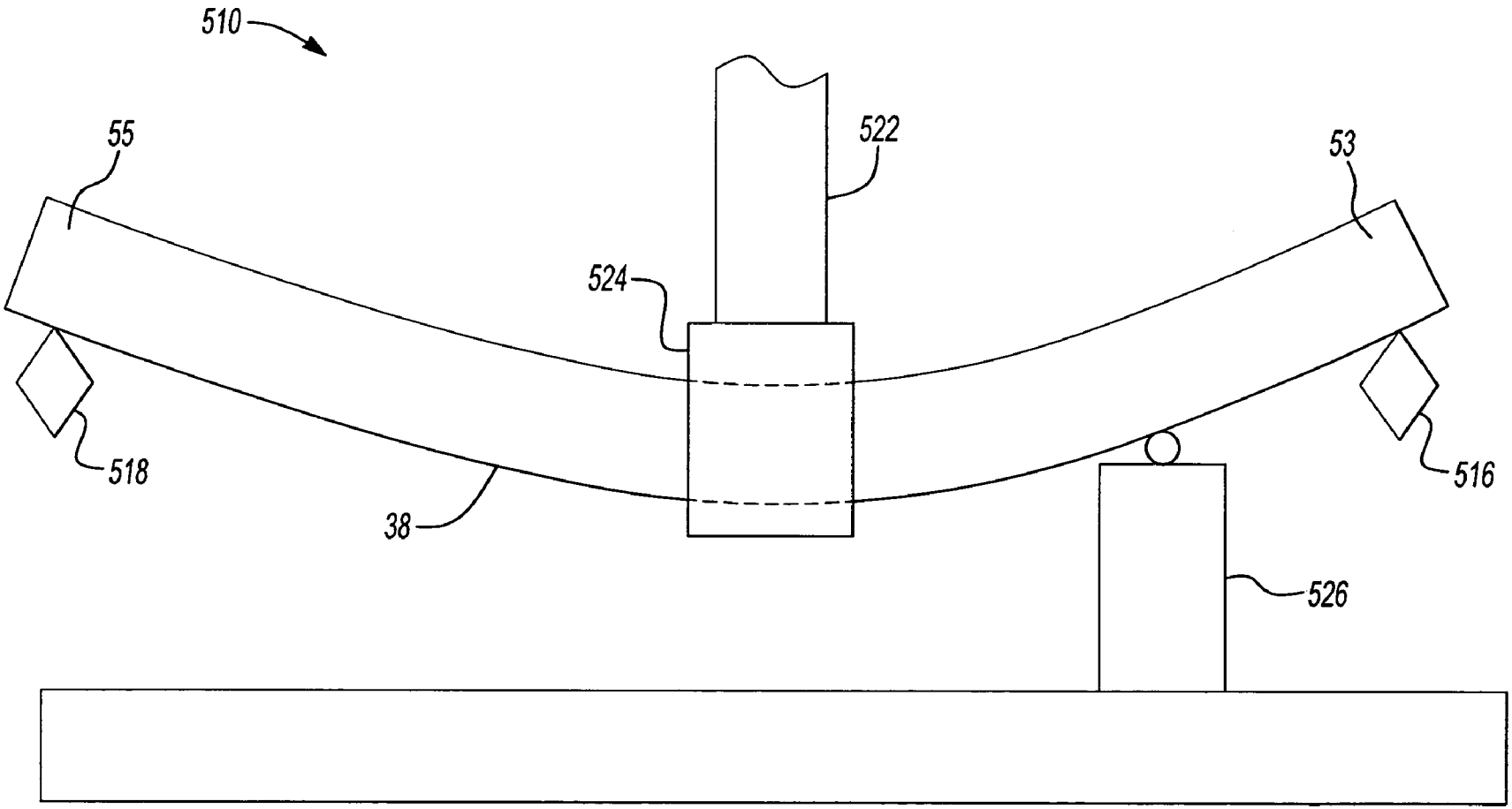
FIG. 6 is a schematic illustration of the drive shaft bending apparatus of FIG. 5 applying a load to the drive shaft.

Pre-bent drive shaft 38 may be formed in a variety of ways. For example, pre-bent drive shaft 38 may be a carbon steel shaft having a bending moment applied thereto. As seen in FIGS. 5 and 6, a shaft bending apparatus 510 is shown engaged with drive shaft 38. FIG. 5 shows shaft bending apparatus 510 and drive shaft 38 before a bending moment is applied to drive shaft 38. FIG. 6 is a schematic illustration of shaft bending apparatus 510 applying a bending moment to drive shaft 38.

Shaft bending apparatus 510 may include a support member 512 and a load applying mechanism 514. Support member 512 may include first and second supports 516, 518 and load applying mechanism 514 may include a load control mechanism 520 and a hydraulic press head 522 having an adapter 524 fixed to an end thereof. Drive shaft 38 may be supported at first and second ends by first and second supports 516, 518. More specifically, first and second bearing portions 53, 55 may be supported on first and second supports 516, 518. Hydraulic press head 522 may be used to apply the bending moment, or load, through adapter 524. Adapter 524 may be engaged with a central portion of drive shaft 38 between first and second supports 516, 518 and may localize load application for consistency. Load control mechanism 520 may meter and control the load magnitude, and therefore the magnitude of the deformation of drive shaft 38.

A displacement transducer 526 (seen in FIG. 6) may additionally be used to monitor deformation of drive shaft 38. Displacement transducer 526 may be a linear variational displacement transducer (LVDT) and may be placed under drive shaft 38 to measure displacement thereof. LVDT 526 measures displacement of drive shaft 38 iteratively until a desired permanent deformation is achieved. Accordingly, the minimum load required for permanent deformation is applied and released before permanent displacement is determined. Thus, if drive shaft 38 is determined to be under-deformed, the bending process is repeated by increasing the magnitude of the load applied to drive shaft 38 until the measured permanent deformation meets the desired permanent deformation.

Drive shaft 38 may initially be in the form of a linear member as shown in FIG. 5. Application of the bending moment is illustrated in FIG. 6. When a bending moment is applied by load applying mechanism 514, as discussed above, the bending moment may increase linearly from the first and second supports 516, 518, where the bending moment is generally zero, to the location where adapter 524 is engaged with drive shaft 38, where the bending moment is at a maximum. The magnitude of the maximum bending moment applied to drive shaft 38 is selected such that a yield point of drive shaft 38 is exceeded and drive shaft 38 is permanently deformed around the location where adapter 524 is engaged therewith. Since drive shaft 38 has a very low bending moment applied around supports 516, 518, there is no permanent deformation around first and second bearing portions 53, 55, resulting in first and second bearing portions 53, 55 and therefore first and second linear portions 226, 228 of centerline 214 maintaining their linearity while the central portion of drive shaft 38 is permanently deformed.

Figure 7:
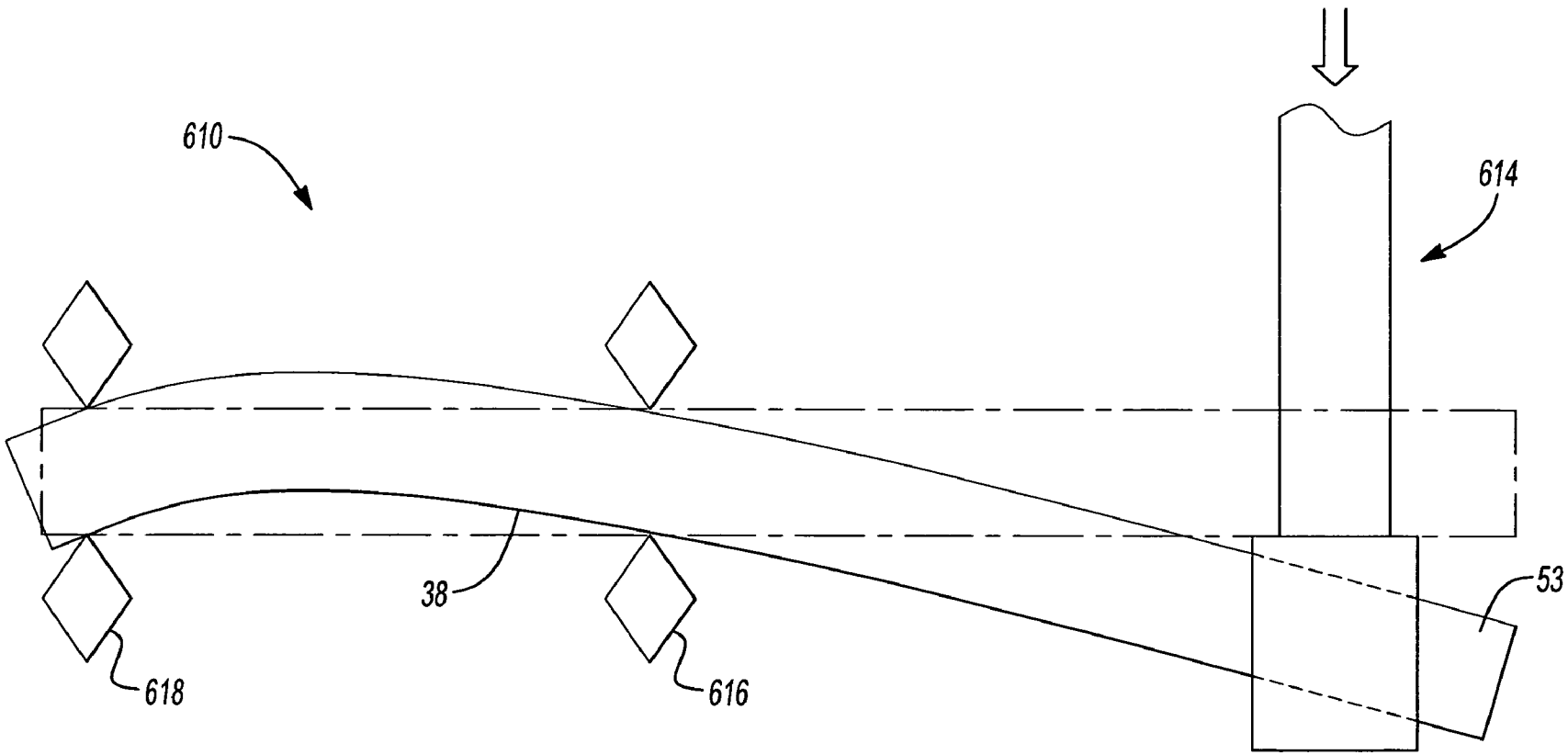
FIG. 7 is a schematic illustration of an alternate drive shaft bending apparatus.

An alternate shaft bending apparatus 610 is shown in FIG. 7. Shaft bending apparatus 610 may be generally similar to shaft bending apparatus 510 shown in FIGS. 5 and 6 with the exception of the location of the supports and load application, discussed below.

Shaft bending apparatus 610 may include first and second supports 616, 618 supporting drive shaft 38 and a load applying mechanism 614 engaged with drive shaft 38. First support 616 may provide a bending location for drive shaft 38 and may be disposed between second support 618 and a load applying mechanism 614. Load applying mechanism 614 may apply a load to an end of drive shaft 38 near first bearing portion 53. The shaft bending apparatus of FIG. 7 may be used to generate a pre-bent drive shaft 38 similar to that created by shaft bending apparatus 510. However, due to the arrangement of supports 616, 618 and load applying mechanism 614, a reduced load magnitude relative to that required by shaft bending apparatus 510 may be used to generate the same amount of permanent deformation of drive shaft 38.

What is claimed is:

1. A compressor drive shaft comprising:

a first bearing portion;

a second bearing portion;

an intermediate portion disposed therebetween and including a continuous, nonlinear, first central axis in an unloaded state; and a rotational axis intersecting said first bearing portion and said second bearing portion, said first bearing portion including a second central axis extending at an angle relative to said rotational axis when in an unloaded state.

2. The compressor drive shaft of claim 1, wherein said angle is approximately one-half of a maximum angular deflection between a free state and an operational state of said compressor drive shaft in a direction generally opposite to the deflection.

3. The compressor drive shaft of claim 1, wherein said angle is greater than or equal to 0.10 degrees.

4. The compressor drive shaft of claim 1, wherein said angle is less than or equal to 0.14 degrees.

5. The compressor drive shaft of claim 1, wherein said angle is less than or equal to the arctan(c/H), where c is a diametrical clearance between said first bearing portion and a compressor bearing housing said first bearing portion therein and H is an axial extent of the compressor bearing.

6. The compressor drive shaft of claim 1, wherein said compressor drive shaft is formed from a single piece of material.

7. The compressor drive shaft of claim 1, wherein said compressor drive shaft is formed from carbon steel.

8. The compressor drive shaft of claim 1, wherein said drive shaft is formed from a ductile iron.

9. The compressor drive shaft of claim 1, wherein said nonlinearity is created by a bending load applied to said intermediate portion of said compressor drive shaft while said first and second bearing portions are supported.

10. The compressor drive shaft of claim 9, wherein the bending load is greater than a yield point of said compressor drive shaft and permanently deforms said intermediate portion of said compressor drive shaft.

11. The compressor drive shaft of claim 1, wherein said nonlinearity is created by a bending load applied to said first bearing portion of said compressor drive shaft while said second bearing portion and said intermediate portion of said compressor drive shaft are supported.

12. The compressor drive shaft of claim 1, wherein said first and second bearing portions are generally linear.

13. The compressor drive shaft of claim 1, wherein a portion of said compressor drive shaft extending between said second bearing portion and said intermediate portion is generally linear and forms a rotor mounting location.

14. A compressor comprising:

a shell;

a first bearing housing contained within said shell having a first bearing contained therein;

a second bearing housing contained within said shell having a second bearing contained therein;

a drive shaft having a first bearing portion, a second bearing portion, and an intermediate portion disposed therebetween, said first bearing portion located within said first bearing and said second bearing portion located within said second bearing, said drive shaft having a rotational axis generally parallel to bearing surfaces of said first and second bearings, said intermediate portion including a continuous, nonlinear, first central axis in an unloaded state and said first bearing portion including a second central axis extending at an angle relative to said rotational axis;

a motor contained within said shell and drivingly coupled to said drive shaft; and a compression mechanism in a driven engagement with said drive shaft.

15. The compressor of claim 14, wherein said angle is approximately one-half of a maximum angular deflection between a free state and an operational state of said drive shaft in a direction generally opposite to the deflection.

16. The compressor of claim 14, wherein said angle is greater than or equal to 0.10 degrees.

17. The compressor of claim 14, wherein said angle is less than or equal to 0.14 degrees.

18. The compressor of claim 14, wherein said angle is less than or equal to the arctan(c/H), where c is a diametrical clearance between said first bearing portion and said first bearing and H is an axial extent of said first bearing.

19. The compressor of claim 14, wherein said drive shaft is formed from a single piece of material.

20. The compressor of claim 14, wherein said drive shaft is formed from carbon steel.

21. The compressor of claim 14, wherein said drive shaft is formed from a ductile iron.

22. The compressor of claim 21, wherein said first and second bearing portions are generally linear.

23. The compressor of claim 14, wherein said nonlinearity is created by a bending load applied to said intermediate portion of said drive shaft while said first and second bearing portions are supported.

24. The compressor of claim 23, wherein bending load is greater than a yield point of said drive shaft and permanently deforms said intermediate portion of said drive shaft.

25. The compressor of claim 14, wherein said nonlinearity is created by a bending load applied to said first bearing portion of said drive shaft while said second bearing portion and said intermediate portion of said drive shaft are supported.

26. The compressor of claim 14, wherein said first and second bearing portions are generally linear.

27. The compressor of claim 14, wherein a portion of said drive shaft extending between said second bearing portion and said intermediate portion is generally linear and has a rotor mounted thereon.

28. The compressor of claim 14, wherein said first and second bearings are axially spaced a distance from one another, a ratio between the distance and an inner diameter of said first bearing being greater than or equal to 10.

29. The compressor of claim 28, wherein said first and second bearing portions are generally linear.

30. A method comprising:

supporting a drive shaft for a compressor at a first location along a length thereof; and applying a load that exceeds a yield point of the drive shaft to a second location along a length thereof to permanently deform the drive shaft a predetermined amount to a nonlinear form.

31. The method of claim 30, further comprising providing a carbon steel drive shaft for the compressor.

32. The method of claim 30, further comprising providing a ductile iron drive shaft for the compressor.

33. The method of claim 30, wherein said supporting includes supporting the drive shaft at first and second locations along a length thereof.

34. The method of claim 33, wherein said applying includes applying the load at a location along the length of the drive shaft between the first and second locations.

35. The method of claim 34, wherein the first and second locations are proximate first and second ends of said drive shaft.

36. The method of claim 33, wherein said applying includes applying the load at a location axially outwardly of both the first and second locations.

37. The method of claim 36, wherein the first location is located proximate a first end of the drive shaft and the second location is located at an intermediate portion of the drive shaft, said applying including applying the load near a second end of the drive shaft.

38. The method of claim 30, further comprising monitoring the permanent deformation of the drive shaft.

39. The method of claim 30, wherein said supporting and said applying permanently deforms an intermediate portion of the drive shaft to create a non-linear central axis at the intermediate portion and does not permanently deform first and second ends of the drive shaft, leaving the first and second ends generally linear.

* * * * *